US010151092B2

(12) United States Patent
Hashimoto et al.

(10) Patent No.: US 10,151,092 B2
(45) Date of Patent: Dec. 11, 2018

(54) FLUSH TOILET APPARATUS

(71) Applicant: TOTO LTD., Kitakyushu-shi, Fukuoka (JP)

(72) Inventors: Hiroshi Hashimoto, Kitakyushu (JP); Masateru Shiraishi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/794,071

(22) Filed: Oct. 26, 2017

(65) Prior Publication Data

US 2018/0135288 A1 May 17, 2018

(30) Foreign Application Priority Data

Nov. 15, 2016 (JP) ..... 2016-222538

(51) Int. Cl.

| | |
|---|---|
| ***E03D 9/08*** | (2006.01) |
| ***E03D 11/13*** | (2006.01) |
| ***B05B 9/00*** | (2006.01) |
| *E03C 1/12* | (2006.01) |

(52) U.S. Cl.

CPC ..... *E03D 9/08* (2013.01); *B05B 9/002* (2013.01); *E03D 11/13* (2013.01); *E03C 2001/1213* (2013.01)

(58) Field of Classification Search

CPC ..... E03D 9/08; E03D 11/13; B05B 9/002
USPC ..... 4/420.5
See application file for complete search history.

(56) References Cited

U.S. PATENT DOCUMENTS

2016/0258151 A1 9/2016 Shiraishi et al.

FOREIGN PATENT DOCUMENTS

| | | | |
|---|---|---|---|
| EP | 2 778 302 | A2 | 9/2014 |
| JP | S63-112578 | U | 7/1988 |
| JP | 2014-189999 | A | 10/2014 |
| JP | 2016-164334 | A | 9/2016 |

OTHER PUBLICATIONS

An Office Action; "Notice of Reasons for Rejection," mailed by the Japanese Patent Office dated Aug. 7, 2017, which corresponds to Japanese Patent Application No. 2016-222538 and is related to the present application; with English language Concise Explanation.

*Primary Examiner* — Tuan N Nguyen
(74) *Attorney, Agent, or Firm* — Studebaker & Brackett PC

(57) ABSTRACT

The present invention is a flush toilet apparatus (1) having a flush toilet main body (2) and a sanitary washing apparatus (18), with a bent supply pipe (28) extending so as to bend from the connecting base end portion (24) of a toilet seat rear portion to supply wash water to a sanitary washing apparatus, a wash water supply pipe (2) connected to this bent supply pipe, and an affixing member (14) for affixing the toilet seat to the flush toilet main body; whereby affixing holes (12) and a pipe opening (16) are provided on the top surface, and the pipe opening is formed outer side of the affixing holes, while the center point of the pipe opening is positioned on the front side of the affixing holes, and the pipe opening center point is positioned on the inside of the connecting base end portion.

9 Claims, 7 Drawing Sheets

FLUSH TOILET APPARATUS

The present invention pertains to a flush toilet apparatus, and more particularly to a flush toilet apparatus having: a flush toilet main body, and a sanitary washing apparatus mounted on the rear portion of the top surface of that toilet.

BACKGROUND

In recent years, sanitary washing apparatuses (perineum washing apparatuses) in which flush water is jetted toward a user's perineum to wash the perineum have become widespread. Such a sanitary washing apparatus must be connected to water supply plumbing to supply wash water for jetting, and to electrical wiring for supplying electrical power to drive a wash water jetting nozzle. Because the sanitary washing apparatus is mounted on the top surface of the flush toilet main body, interference by plumbing and wiring with the flush toilet main body is generally avoided by connecting water supply pipes and electrical wiring on the side surface of the sanitary washing apparatus. However, when water supply pipes and electrical wiring are connected to the side surface of a sanitary washing apparatus, the pipes and wiring are exposed on the outside of the flush toilet main body, thereby detracting from the external appearance of the flush toilet apparatus as a whole. Also, effort is required to remove dust accumulating on exposed wiring and plumbing, and cleanability of the flush toilet apparatus as a whole is degraded.

Japanese Published Unexamined Patent Application JP2014189999 (Patent Document 1) sets forth a sanitary washing apparatus and toilet apparatus. In this sanitary washing apparatus, supply plumbing for supplying wash water is made to project rearward from the sanitary washing apparatus, and plumbing projecting rearward is bent further downward to pass through an opening formed on the top surface of the flush toilet main body. Using this sanitary washing apparatus, supply piping does not project to the side of the flush toilet, and thus can be easily hidden.

European Patent Application Publication EP2778302A2 (Patent Document 2) sets forth a wall-mounted toilet. In this wall-mounted toilet, an accessory hole for admitting electrical cords and supply plumbing is formed on the top surface of the flush toilet.

PRIOR ART REFERENCES

Patent Documents

Patent Document 1: Japanese Published Unexamined Patent Application JP2014189999A Patent Document 2: European Patent Application Publication EP2778302A2

SUMMARY OF THE INVENTION

Problems to be Resolved by the Present Invention

In general, a flush toilet apparatus is disposed in a small washroom, and the rear surface of the flush toilet apparatus is disposed close to the washroom wall surface. Installers placing a flush toilet apparatus in a washroom are often unable to reach around the rear surface of the flush toilet apparatus to perform installation work, or it can be difficult to perform work from the side surface of the flush toilet apparatus. Thus there are a variety of limitations on the work of installing a flush toilet apparatus in a washroom, and installation work is frequently cumbersome.

In the flush toilet apparatuses of Patent Documents 1 and 2, water supply pipes for supplying wash water to a sanitary washing apparatus can be passed through an opening erected on the top surface of a flush toilet main body, and a good external appearance of the flush toilet apparatus can be achieved without exposing the plumbing, etc. on the side surface of the flush toilet apparatus. However, when installing these flush toilet apparatuses, water supply plumbing and the like is first connected to the sanitary washing apparatus, and plumbing or the like extending from the sanitary washing apparatus is inserted into an opening formed on the top surface of the flush toilet main body. Next, as pipes or the like are pushed through openings, the sanitary washing apparatus to which piping and the like are connected must be disposed at an appropriate location on the top surface of the flush toilet and affixed.

As described above, various restrictions are imposed on flush toilet apparatus installation work, and installers have the problem that they must perform this work under these many work restrictions. An additional problem is that openings for passing through piping and the like are frequently disposed on the rear portion of the flush toilet main body, in a position particularly difficult for installers to reach during installation, thereby making the work difficult. There is also some degree of stiffness in the water supply pipes connected to the sanitary washing apparatus, so that they cannot be bent to a small curvature radius. Such difficult-to-bend supply piping must be passed through an opening disposed on a flush toilet main body in a work space with many limitations, which frequently impedes the work.

Therefore this invention has the object of providing a flush toilet apparatus offering good installability with favorable exterior appearance and cleanability.

Means for Resolving Problems

To resolve the above-described problems, the present invention is a flush toilet apparatus comprising a flush toilet main body and a sanitary washing apparatus mounted on a rear portion of a top surface thereof, comprising: a bent supply pipe extending from a connecting base end portion toward an inside in a left-right direction of the flush toilet main body to supply wash water to the sanitary washing apparatus, the connecting base end portion being disposed on a side end portion of a bottom surface of the sanitary washing apparatus; a wash water supply pipe connected to the bent supply pipe, to supply the wash water into the bent supply pipe; and an affixing member, disposed between the bottom surface of the sanitary washing apparatus and the top surface of the toilet main body, for affixing the sanitary washing apparatus to the flush toilet main body; wherein an affixing hole for affixing the affixing member to the flush toilet main body, and a pipe opening for admitting the wash water supply pipe are formed on the top surface of the toilet main body; the affixing hole and the pipe opening are formed so as to be covered by the sanitary washing apparatus mounted on the top surface; the pipe opening is positioned on an outer side of the affixing hole in a left-right direction of the flush toilet main body, and a center point in a front-back direction of the pipe opening is positioned on a front side of a center point in the front-back direction of the affixing hole; and the pipe opening, as seen in plan view, is formed so that a center point in the front-back direction of the pipe opening is positioned on an inner side of the connecting base end portion in the left-right direction of the flush toilet main body.

In the invention thus constituted, the affixing holes and pipe opening are covered by the sanitary washing apparatus mounted on the toilet top surface, therefore wash water supply pipes passing through the pipe opening can be hidden, the exterior appearance of the flush toilet apparatus as a whole can be improved, and cleanability can be improved. Also, the pipe opening for admitting wash water supply pipes is formed further to the outside in the left-right direction than the affixing holes, and the center point thereof is positioned further to the front than the center point in the front-back direction of the affixing holes, therefore installers can place the sanitary washing apparatus in an appropriate location on the top surface of the toilet, while easily visually confirming the wash water supply pipes passing through the pipe opening, and access to the wash water supply pipes during installation is made easier. In addition, the bent supply pipe extends from the connecting base end portion placed on the side end portion of the bottom surface of the sanitary washing apparatus, so as to bend inward in the left-right direction of the flush toilet main body, and the flush toilet supply pipe is connected to this bent supply pipe. On the other hand, the center point in the left-right direction of the pipe opening is formed to be positioned further to the inside in the left-right direction than the connecting base end portion, and thus can be smoothly introduced into the pipe opening without excessive bending of the wash water supply pipe extending from the bent supply pipe, so that the sanitary washing apparatus can be easily placed at an appropriate location on the toilet top surface, and the wash water supply pipe can be securely hidden.

In the present invention, preferably, the pipe opening is formed so that its back end point in the front-back direction of the flush toilet main body is positioned on a rear side of a back end point in the front-back direction of the affixing hole.

When the flush toilet main body is ceramic, the flush toilet main body shrinks toward the center during firing. In the invention thus constituted, the back end in the front-back direction is formed to be positioned further to the rear side of the flush toilet main body than the back end in the front-back direction of the affixing holes. Thus during firing, the direction in which the affixing hole edge part shrinks and the direction in which the pipe opening edge part shrinks become close to parallel, and "cracking" during firing is less likely to occur, so that flush toilet main body manufacturing yield can be improved.

In the present invention, preferably, the bent supply pipe is connected so as to be rotatable relative to the connecting base end portion, and a leading end of the bent supply pipe, to which the wash water supply pipe connects, is moved by the rotation of the bent supply pipe in an approximately horizontal plane.

In the invention thus constituted, the bent supply pipe is connected so as to be rotatable relative to the connecting base end portion, so the wash water supply pipe connected to the bent supply pipe can be easily turned. When placing a sanitary washing apparatus on the flush toilet main body, if force is applied to the wash water supply pipe extending from the sanitary washing apparatus into the pipe opening, that force can be dissipated by the rotation of the bent supply pipe, therefore excessive force on the bent supply pipe to which the wash water supply pipe is connected, and the resulting breakage thereof, can be prevented.

In the present invention, preferably, the pipe opening is formed so that its back end point in the front-back direction, as seen in plan view, is positioned on the front side of the connecting base end portion.

In the invention thus constituted, the back end in the front-back direction of the pipe opening is formed to be positioned more to the front side of the flush toilet main body than the connecting base end portion thereof. As a result, when the wash water supply pipe is pulled out toward the rear of the flush toilet main body after the sanitary washing apparatus is installed on the flush toilet main body, that tension force can also be dissipated to the bent supply pipe as compressive force. This allows for a reduction in the risk of breakage of the wash water supply pipe and the like when the wash water supply pipe is pulled with excessive force.

In the present invention, preferably, a plumbing passageway, communicating with the pipe opening and opened toward the rear of the flush toilet main body, is provided in the flush toilet main body, wherein one of side wall surfaces forming the plumbing passageway is positioned on the inside of a vertical plane in the left-right direction of the flush toilet main body, the vertical plane passing through the center point in the left-right direction of the pipe opening, whereby the one of the side wall surfaces guides a wash water supply pipe connected to the bent supply pipe.

In the invention thus constituted, a plumbing passageway communicating with the pipe opening is provided, and one of the side wall surfaces thereof is positioned further to the inside in the left-right direction of the flush toilet main body than the vertical plane passing through the center point in the left-right direction of the pipe opening. Thus when a wash water supply pipe, connected to a bent supply pipe directed inward in the left-right direction, and itself directed inward in the left-right direction, is inserted into a pipe opening, the wash water supply pipe hits the side wall surface of the plumbing passageway and is guided by same, to be pushed toward the rear of the flush toilet main body. Therefore an installer can, in a simple manner, direct a wash water supply pipe inserted in a pipe opening to the back side of the flush toilet main body.

In the present invention, preferably, the side wall surfaces and a bottom wall surface of the plumbing passageway for guiding the wash water supply pipe are formed to slope downward, from the inside toward the outside in the left-right direction of the flush toilet main body.

In the invention thus constituted, the side wall surface and bottom wall surface of the plumbing passageway slope downward, from the inside toward the outside in the left-right direction of the flush toilet main body, therefore wash water supply pipes guided by these walls are fed out from the plumbing passageway, toward the rear and outside of the flush toilet main body. Therefore an installer can easily access fed-out wash water supply pipes.

In the present invention, preferably, a bottom wall surface of the plumbing passageway is formed to slope downward toward the back of the flush toilet main body.

In the invention thus constituted, the plumbing passageway bottom wall surface is formed to slope downward toward the back of the flush toilet main body, therefore wash water supply pipes inserted into the plumbing passageway can be easily fed out to the back of the flush toilet main body. Also, flush water or condensate penetrating into the plumbing passageway can be discharged from the plumbing passageway by the slope of the bottom wall surface.

In the present invention, preferably, a cross sectional area of the plumbing passageway is formed to gradually increase toward the back of the flush toilet main body.

In the invention thus constituted, the cross sectional area of the plumbing passageway is formed to gradually increase toward the back of the flush toilet main body, therefore a wash water supply pipe inserted into the plumbing passageway can be easily passed through it.

In the present invention, preferably, a water proofing member for constraining a penetration of water into the pipe opening is disposed between the top surface of the flush toilet main body and the bottom surface of the sanitary washing apparatus.

In the invention thus constituted, a water proofing member is disposed between the toilet top surface and the bottom surface of the sanitary washing apparatus, therefore flush water or the like flowing on the top surface of the toilet can be prevented from passing through the pipe opening and entering the flush toilet main body.

Effect of the Invention

With the present invention, a flush toilet having good installability while securing favorable exterior appearance and cleanability can be provided.

EMBODIMENTS OF THE INVENTION

Next, referring to the attached drawings, we explain preferred embodiments of the invention.

First, referring to FIGS. 1 through 6, we explain a flush toilet apparatus according to a first embodiment of the present invention.

Figure 1:
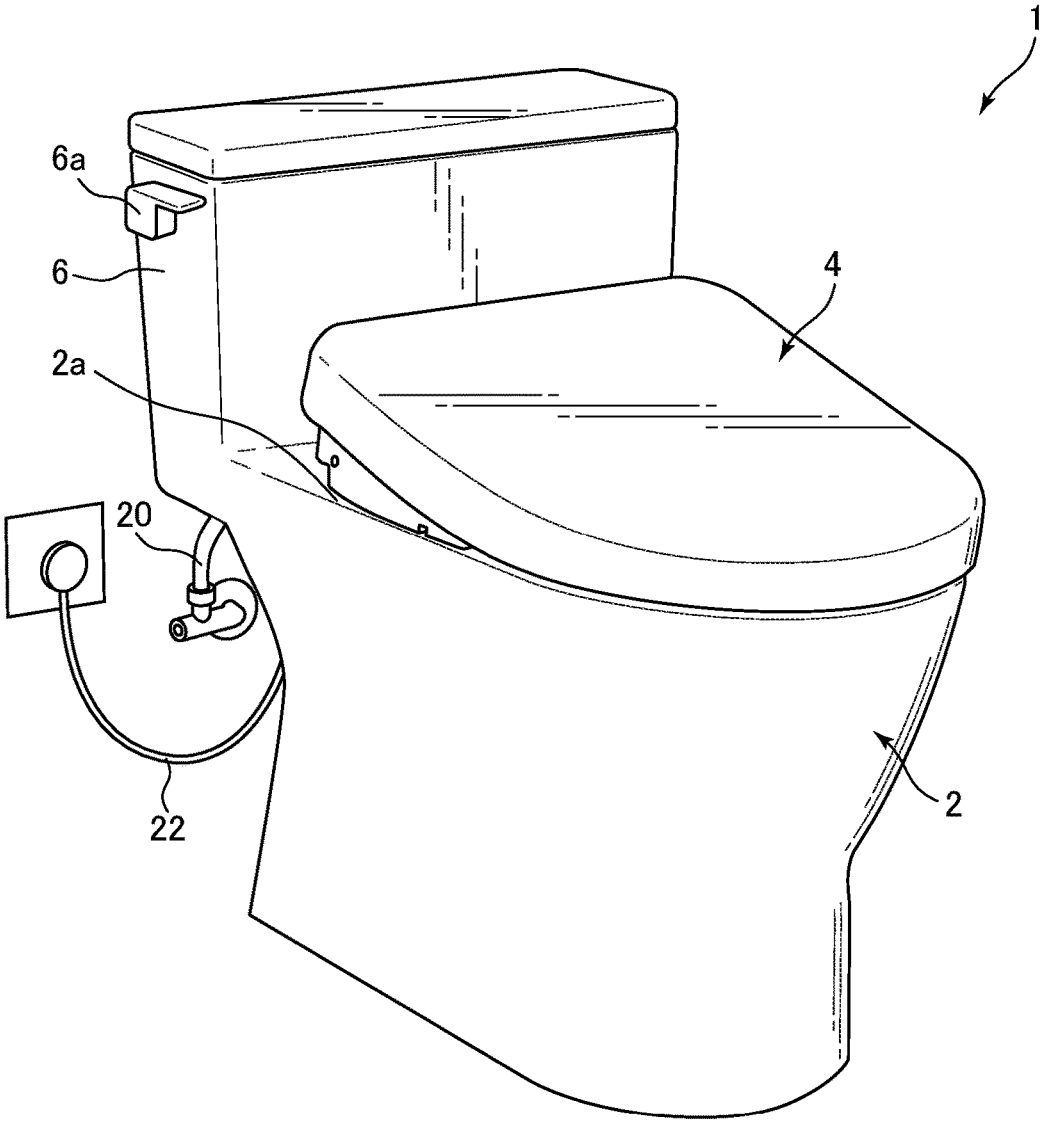
FIG. 1: A perspective view showing the exterior appearance of a flush toilet apparatus according to a first embodiment of the invention.
Figure 2:
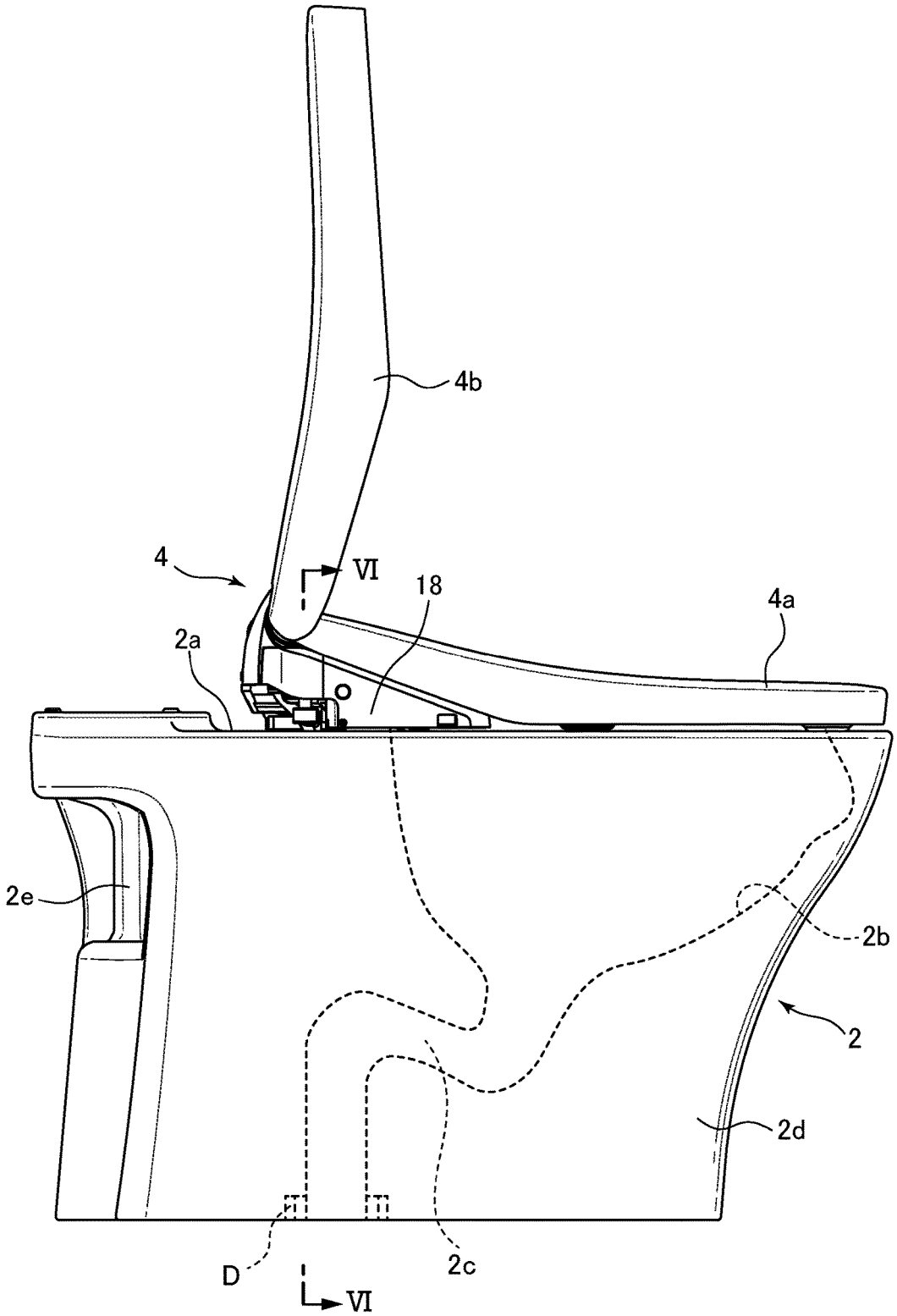
FIG. 2: A side view showing a flush toilet apparatus according to a first embodiment of the invention with the reservoir tank removed.
Figure 3:
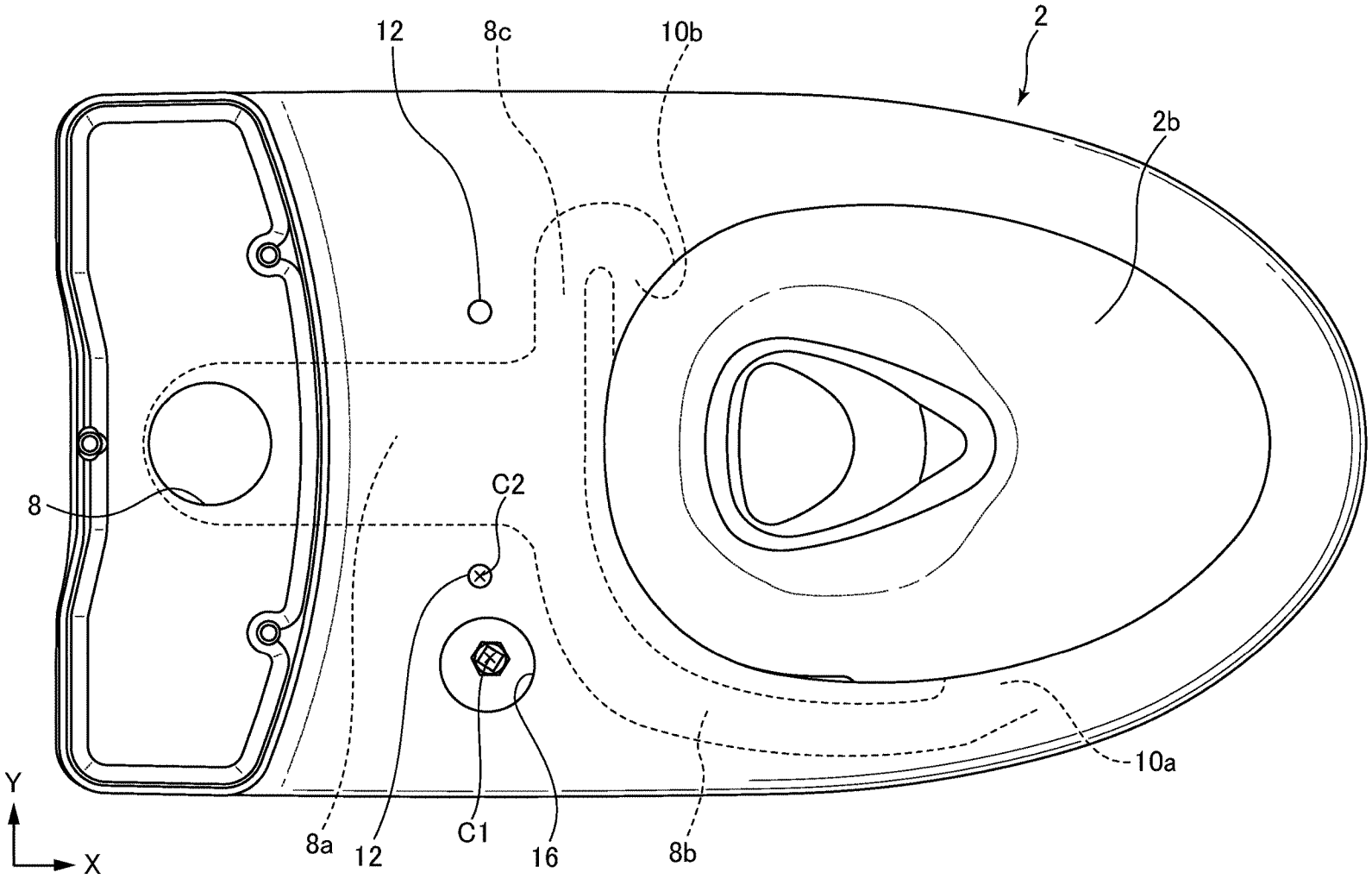
FIG. 3: A plan view of a flush toilet apparatus in a first embodiment of the invention.
Figure 4:
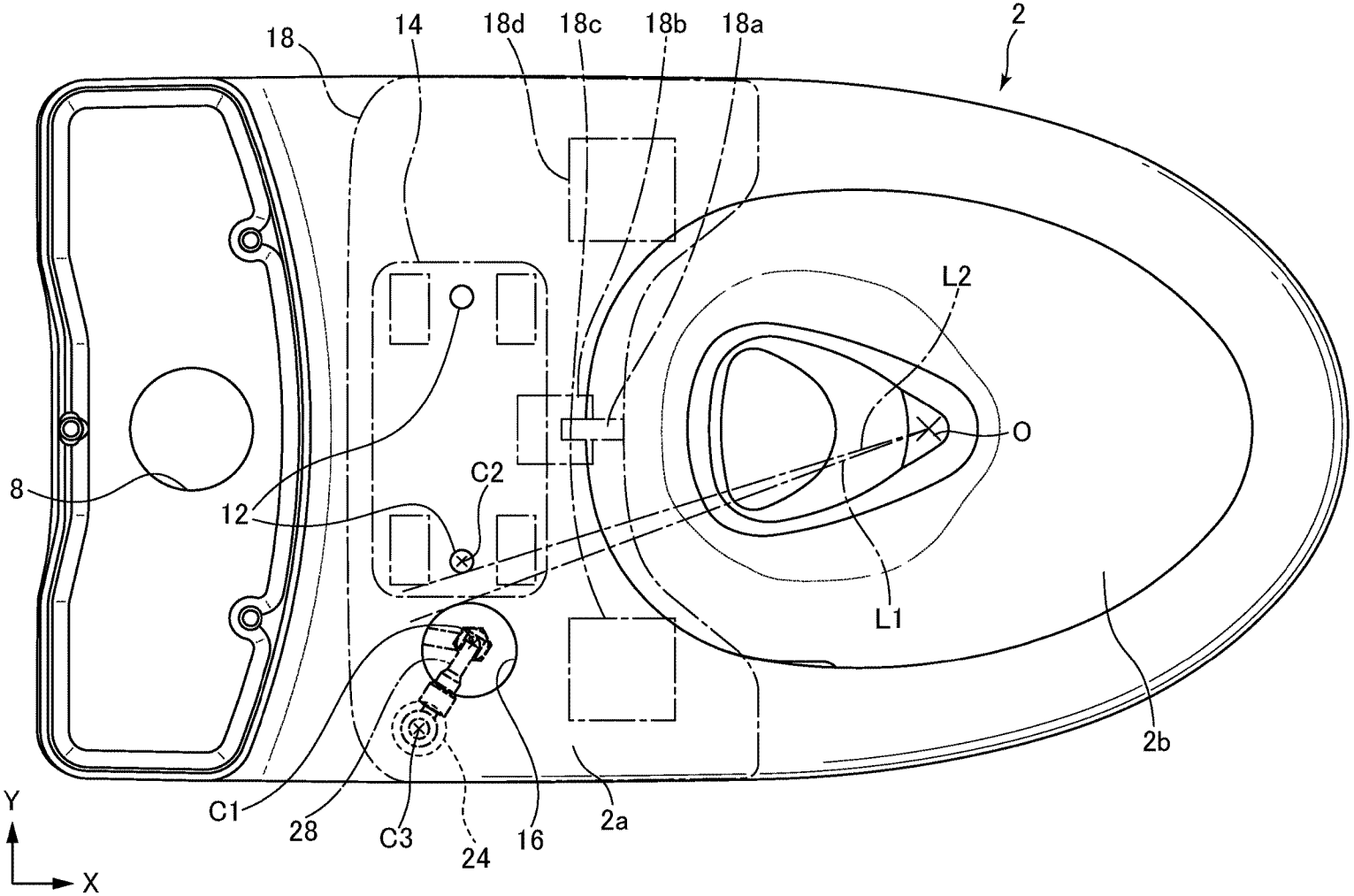
FIG. 4: A plan view of a flush toilet main body in a first embodiment of the invention showing the positional relationship between a flush toilet main body and a sanitary washing apparatus disposed above it.

Referring to FIGS. 1 through 4, we explain the basic structure of a flush toilet apparatus according to a first embodiment of the invention. FIG. 1 is a perspective view showing the exterior appearance of a flush toilet apparatus according to a first embodiment of the invention; FIG. 2 is a side elevation showing the flush toilet apparatus with the reservoir tank removed. FIG. 3 is a plan view of a flush toilet main body. FIG. 4 is a plan view of a flush toilet main body showing the positional relationship between a flush toilet main body and a sanitary washing apparatus disposed above it.

As shown in FIG. 1, flush toilet apparatus 1 of the present embodiment has: a flush toilet main body 2, a toilet seat 4 disposed on the toilet top surface 2*a* of this flush toilet main body 2, and a reservoir tank 6 disposed at the rear portion of the toilet top surface 2*a*.

As shown in FIG. 2, a bowl portion 2*b* for receiving waste, a discharge trap pipe 2*c* communicating with the bottom portion of this bowl portion 2*b*, a skirt portion 2*d* covering the perimeter side surface of the flush toilet main body 2, and a plumbing passageway 2*e* opening toward the back of the flush toilet main body 2 are formed on the flush toilet main body 2. Note that in the present embodiment the flush toilet main body 2 is made of ceramic, and is floor-mounted.

As shown in FIG. 3, a rim portion is formed on the outer perimeter top portion of the bowl portion 2*b*, and a first spout port 10*a* and second spout port 10*b* are placed on this rim portion. User operation of an operating portion 6*a* (FIG. 1) disposed on the reservoir tank 6 causes flush water in the reservoir tank 6 to be discharged from each spout port. The waste receiving surface of the bowl portion 2*b* is flushed by the flush water spouted from these spout ports. Flush water flushing the bowl portion 2*b* passes through the discharge trap pipe 2*c* communicating with the bottom portion of the bowl portion 2*b* and is discharged from discharge pipe D together with waste.

A skirt portion 2*d* (FIG. 2) in this embodiment is disposed on the entire perimeter of the side surface of the flush toilet main body 2, so as to surround the perimeter of the bowl portion 2*b*. Also, no skirt portion 2*d* is disposed above the rear surface side of the flush toilet main body 2, and a plumbing passageway 2*e* extending inward on the skirt portion 2*d* from the rear surface of the flush toilet main body 2 is disposed on this part.

As shown in FIG. 3, a bowl portion 2*b* is opened on the front side of the toilet top surface 2*a* on the flush toilet main body 2, and a wash water supply hole 8 is disposed on the center in the left-right direction and the back end portion of the toilet top surface 2*a*. This wash water supply hole 8 is disposed on the inside of the flush toilet main body 2, and communicates with a center water conduit 8*a* extending toward the front of the flush toilet main body 2. This center water conduit 8*a* branches into a first water conduit 8*b* and a second water conduit 8*c* at the back of the bowl portion 2*b*; the first water conduit 8*b* extends along the outer perimeter of the bowl portion 2*b* up to a first spout port 10*a* disposed on the side portion of the bowl portion 2*b*; the second water conduit 8*c* extends to a second spout port 10*b* disposed on the rear portion of the bowl portion 2*b*. When flushing the bowl portion 2*b*, flush water accumulated in the reservoir tank 6 flows through the wash water supply hole 8 and into the flush toilet main body 2, then passes from the center water conduit 8*a* through the first and second water conduits to be discharged from the first and second spout ports, respectively.

Note that in this Specification, the direction shown as the X axis in FIG. 3 is the front-back direction of the flush toilet main body 2, and the direction shown as the Y axis is the left-right direction of the flush toilet main body 2. Also, the right side in FIG. 3 is the front of the flush toilet main body 2, and the left side thereof is the rear of the flush toilet main body 2. In addition, the side of the flush toilet main body 2 close to the center axis line in the front-back direction (X axis direction) of the flush toilet main body 2 is the inside in the left-right direction of the flush toilet main body 2, while the side far from the center axis line is the outside in the left-right direction of the flush toilet main body 2.

Next, as shown in FIG. 2, the toilet seat 4 has: a seat portion 4*a* on which a user sits, a toilet seat cover 4*b* covering this seat portion 4*a*, and a sanitary washing apparatus 18 disposed at the rear of the bowl portion 2*b*.

The seat portion 4*a* is a ring-shaped member on which a user sits; it is disposed on the flush toilet main body 2 top surface 2*a*.

The toilet seat cover 4*b* is placed so as to be rotatable about a horizontal axial line at its back end; at a closed position where it is directed approximately horizontally, it covers the seat portion 4*a* and the sanitary washing apparatus 18 from above; at the open position where it is directed approximately vertically, it exposes the seat portion 4*a* and the sanitary washing apparatus 18.

The sanitary washing apparatus 18 is a functional unit, attached at the rear of the bowl portion 2*b* on the toilet top surface 2*a* and extending in the left-right direction of the flush toilet main body 2; the toilet seat cover 4*b* is rotatably supported by the top end portion thereof.

As shown in FIG. 4, the sanitary washing apparatus 18 comprises: a jet nozzle 18*a* for jetting wash water toward a user's perineum; a nozzle drive device 18*b* for driving this jet nozzle 18*a*; a heating device 18*c* for heating wash water to be jetted from the nozzle; and a microprocessor 18*d* for controlling these devices (the above not shown), and the like.

Moreover, a wash water supply pipe 20 (FIG. 6) for supplying wash water to be jetted from the jet nozzle 18*a*, and a power supply cable 22 (FIG. 6) for supplying power to operate the nozzle drive device 18*b* and the microprocessor 18*d* etc. is connected to the sanitary washing apparatus 18. This wash water supply pipe 20 and power supply cable 22 are connected to the bottom surface of the sanitary washing apparatus 18 (FIG. 6) and pulled to the rear of the flush toilet main body 2 through the plumbing passageway 2*e*.

Figure 5:
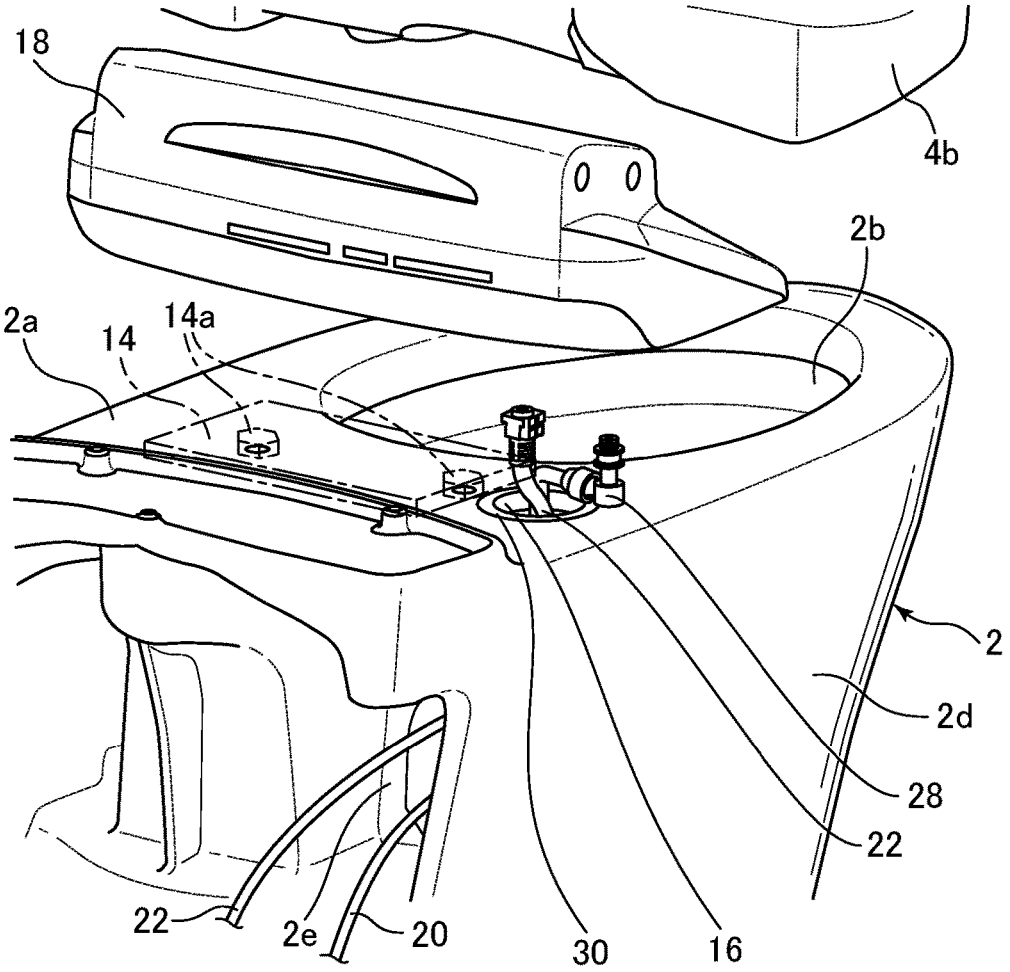
FIG. 5: An exploded perspective view in which the toilet seat sanitary washing apparatus, seat portion, and toilet seat cover are removed from a flush toilet main body in a first embodiment of the invention.
Figure 6:
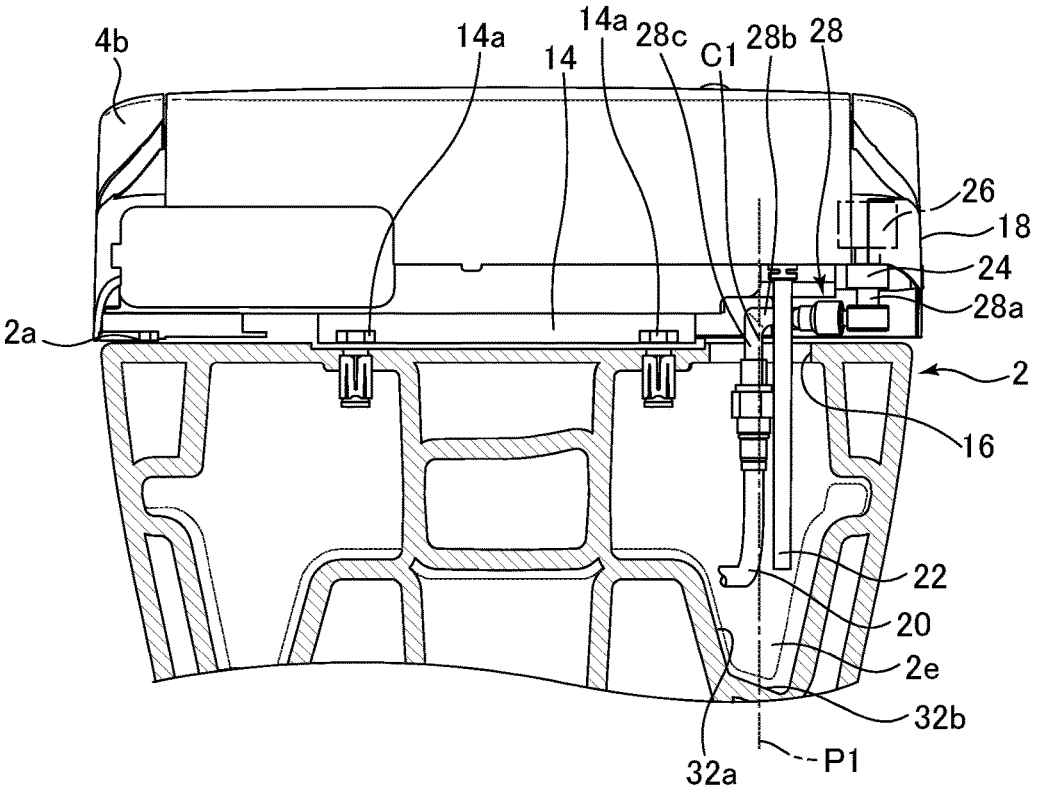
FIG. 6: A rear face partial cross section showing the connection of wash water supply pipes and power supply cables to a sanitary washing apparatus in a first embodiment of the invention.

Next, referring to FIGS. 4 through 6, we explain a structure for attaching the toilet seat 4 to the flush toilet main body 2. FIG. 5 is an exploded perspective view with the toilet seat sanitary washing apparatus, seat portion, and toilet seat cover removed from the flush toilet main body. FIG. 6 is a rear face partial cross section showing the connection of wash water supply pipes and power supply cables to a sanitary washing apparatus, in which a portion of the sanitary washing apparatus housing cover and flush toilet main body are cut away.

As shown in FIG. 4, two affixing holes 12 with circular cross sections are respectively disposed on the toilet top surface 2*a* of the flush toilet main body 2. These affixing holes 12 are disposed at left-right symmetrical positions on both sides of the center water conduit 8*a* (FIG. 3) extending into the interior of the flush toilet main body 2. Also, the affixing holes 12 are respectively disposed on the back side of the first water conduit 8*b* and second water conduit 8*c* (FIG. 3), which branch from the center water conduit 8*a* and extend to the left and right at the back of the bowl portion 2*b*. These affixing holes 12 are holes for affixing an affixing member 14 disposed between the toilet top surface 2*a* and the bottom surface of the sanitary washing apparatus 18. The sanitary washing apparatus 18 is affixed through this affixing member 14 to the toilet top surface 2*a* on the flush toilet main body 2. Specifically, the affixing member 14 is affixed to the flush toilet main body 2 toilet top surface 2*a* by affixing two affixing bolts 14*a* to the affixing holes 12, and the bottom surface of the toilet seat 4 sanitary washing apparatus 18 is snap-fastened to the affixing member 14.

Note that the affixing member may also be integrally formed with the bottom surface of the sanitary washing apparatus. In this case, the bottom surface of the sanitary washing apparatus is affixed to an affixing hole using predetermined affixing hardware, after the sanitary washing apparatus is disposed on the toilet top surface.

In addition, as shown in FIG. 4, a pipe opening 16 with a circular cross section larger than the affixing holes 12 is disposed on the flush toilet main body 2 toilet top surface 2*a*, and flexible wash water supply pipes and power supply cables are connected to the sanitary washing apparatus 18 through this pipe opening 16. This pipe opening 16 is placed further to the outside in the left-right direction of the flush toilet main body 2 than the affixing holes 12. This pipe opening 16 and affixing holes 12 are formed at positions and dimensions such that they are completely covered by the toilet seat 4 sanitary washing apparatus 18 disposed on the toilet top surface 2*a* of the flush toilet main body 2. Therefore when the toilet seat 4 is disposed on the flush toilet main body 2, the pipe opening 16 and the affixing holes 12 are not visually perceived by a user. In addition, a packing 30, being a waterproof member, is disposed between the flush toilet main body 2 toilet top surface 2*a* and the sanitary washing apparatus 18 bottom surface, constraining the penetration of water into the pipe opening 16. I.e., a ring-shaped packing 30 is disposed so as to surround the pipe opening 16, and water penetrating onto the toilet top surface 2*a* is prevented from passing through the pipe opening 16 and penetrating into the interior of the flush toilet main body 2.

Also, the center point C1 in the front-back direction of the pipe opening 16 is positioned further to the front of the flush toilet main body 2 than the center point C2 in the front-back direction of the affixing holes 12. Note also that in the present embodiment, because the pipe opening 16 and affixing holes 12 both have circular cross sections, the center point C1 in the front-back direction of the pipe opening 16 and the center point C2 in the front-back direction of the affixing holes 12 both match the center of the circle. In addition, the back end in the front-back direction of the pipe opening 16 is positioned further to the rear side of the flush toilet main body 2 than the back end in the front-back direction of the affixing holes 12. I.e., in the present embodiment the affixing holes 12 are formed in a region between the front end and the back end in the front-back direction of the pipe opening 16. In this manner, the pipe opening 16 is formed in an area surrounded by: a first water conduit 8*b* (FIG. 3) disposed on the outer perimeter of the bowl portion 2*b*, the affixing holes 12, and the side edge of the flush toilet main body 2.

Here, as shown in FIG. 4, the flush toilet main body 2 generally shrinks overall toward the vicinity of the bowl portion 2*b* center point O during firing. Therefore the part between the affixing holes 12 and the pipe opening 16 also shrinks toward the center point O vicinity at this time. Here, because the tangent L1 passing through center point O and touching the pipe opening 16 and the tangent L2 passing through center point O and touching the affixing holes 12 are close to parallel, the stress acting on the part between the affixing holes 12 and the pipe opening 16 during shrinkage is relatively small. This enables the occurrence of "cracking" associated with shrinkage during firing to be constrained, so that flush toilet main body 2 yields can be improved.

On the other hand, when the back end in the front-back direction of the pipe opening 16 is positioned further to the front of the flush toilet main body 2 than the back end in the front-back direction of the affixing holes 12, the angle formed by the tangents L1 and L2 increases. Therefore when shrinkage occurs due to firing, the stress acting on the part between the affixing holes 12 and the pipe opening 16 increases, and there is a risk that "cracking" will be more prone to occur.

Next, referring to FIGS. 4 through 6, we explain the connection of the wash water supply pipe 20 and the power supply cable 22 to the sanitary washing apparatus 18.

First, as shown in FIG. 6, the power supply cable 22 extends in approximately the vertical direction through the pipe opening 16, and is connected to the sanitary washing apparatus 18. At the same time, the wash water supply pipe 20 is connected to a connecting base end portion 24 within the sanitary washing apparatus 18. This connecting base end portion 24 is a cylindrical passageway for accepting, in an approximately vertical direction, piping which enables the in-flow of municipal water supplied through the wash water supply pipe 20 to be flowed in. The connecting base end portion 24, seen in plan view, is disposed on the side end portion of the rear portion of the sanitary washing apparatus 18; an electromagnetic valve 26 is connected at the top thereof. The inflow and cutoff of municipal water supplied through the wash water supply pipe 20 into the sanitary washing apparatus 18 is switched by this electromagnetic valve 26.

As shown in FIG. 6, the connecting base end portion 24 is positioned on the outside in the left-right direction of the flush toilet main body 2 relative to the pipe opening 16. Stated another way, seen in plan view, the center point in the left-right direction of the pipe opening 16 is formed to be positioned more to the inside in the left-right direction of the flush toilet main body 2 than the connecting base end portion 24. At the same time, the bent supply pipe 28 extends from the connecting base end portion 24 so as to bend toward the inside in the left-right direction of the flush toilet main body 2, and the wash water supply pipe 20 is connected through the bent supply pipe 28 to the connecting base end portion 24.

Also, as shown in FIG. 4, in the present embodiment the back end of the pipe opening 16, as seen in plan view, is positioned more to the front side of the flush toilet main body 2 than the center point C3 in the front-back direction of the connecting base end portion 24. Therefore when the wash water supply pipe 20 is pulled out toward the rear of the flush toilet main body 2 after the toilet seat 4 is installed on the flush toilet main body 2, this tension force acts on the wash water supply pipe 20 itself, and can be made to dissipate and act as compressive force on the bent supply pipe 28 as well. In contrast to this, if the back end of the pipe opening 16 is positioned further to the rear than the center point C3 of the connecting base end portion 24, then when the wash water supply pipe 20 is pulled toward the rear of the flush toilet main body 2, there is a risk that the wash water supply pipe 20 will contact the back end of the pipe opening 16 such that this becomes a fulcrum concentrating all of the tension on the wash water supply pipe 20, damaging the wash water supply pipe 20.

Note that in the present embodiment, the bent supply pipe 28 is constituted by an outflow pipe portion 28*a* extending approximately in the vertical direction from the connecting base end portion 24, a bent supply pipe 28 extending in approximately the horizontal direction from the outflow pipe portion 28*a*, and a crank-shaped pipe member made up of an inflow pipe portion 28*c* extending in approximately the vertical direction from this horizontal pipe portion 28*b*. For this reason, the bent supply pipe 28 outflow pipe portion 28*a* extends approximately vertically downward from the connecting base end portion 24. In addition, the horizontal pipe portion 28*b* extends approximately parallel to the toilet top surface 2*a* toward the inside in the left-right direction of the flush toilet main body 2, above the toilet top surface 2*a*. Also, the inflow pipe portion 28*c* extends from the upstream end of the horizontal pipe portion 28*b* approximately vertically downward in the pipe opening 16, and the wash water supply pipe 20 is connected at the bottom end thereof.

Also, in the present embodiment the bent supply pipe 28 outflow pipe portion 28*a* is rotatably connected to the connecting base end portion 24. Therefore when the bent supply pipe 28 is rotated about an approximately vertical axial line relative to the connecting base end portion 24, the end of the bent supply pipe 28 (the upstream end of the inflow pipe portion 28*c*) is moved within an approximately horizontal plane. However, because the connecting base end portion 24 is placed on the side end portion of the sanitary washing apparatus 18, the bent supply pipe 28 cannot be rotated to the position at which it will bend toward the outside in the left-right direction of the flush toilet main body 2.

Note also that in the present embodiment, the bent supply pipe 28 is constituted by a pipe member bent in a crank shape, however the bent supply pipe 28 can also be constituted by an approximately L-shaped pipe member formed by an outflow pipe portion and a horizontal pipe portion, or by a pipe member in which a curved portion is gradually bent at a predetermined curvature radius, or the like. Also, in the present embodiment the bent supply pipe 28 curved portion is bent at 90°, but the angle of the bend or curve may be freely set.

Next, referring to FIGS. 5 and 6, we explain the constitution of the plumbing passageway 2*e* placed on the flush toilet main body 2.

The plumbing passageway 2*e* is a passageway disposed to open toward the rear on the flush toilet main body 2, into which the wash water supply pipe 20 and power supply cable 22 are inserted and guided. As shown in FIG. 6, the plumbing passageway 2*e* is a passageway constituted by approximately flat wall surfaces consisting of its ceiling, floor, and two side surface, and has side wall surfaces 32*a*. The cross sectional area of this plumbing passageway 2*e* gradually increases toward the rear of the flush toilet main body 2.

An inside side wall surface 32*a* and bottom wall surface 32*b* forming the plumbing passageway 2*e* are formed to slope from the inside in the left-right direction of the flush toilet main body 2 downward toward the outside. Also, the bottom wall surface 32*b* is formed to slope downward toward the rear of the flush toilet main body 2. In addition, the plumbing passageway 2*e* side wall surface 32*a* is positioned to be further inside in the left-right direction of the flush toilet main body 2 than the vertical plane P1 passing through the center point in the left-right direction of the pipe opening 16, and is constituted to guide the wash water supply pipe 20 and power supply cable 22 inserted from the pipe opening 16.

Next we explain the installation procedure for a flush toilet apparatus 1 according to a first embodiment of the invention.

First, as shown in FIG. 2, the flush toilet main body 2 is disposed and affixed on the floor so that the discharge trap pipe 2*c* on the flush toilet main body 2 can be connected to a discharge pipe D raised from the floor of the washroom where the flush toilet apparatus 1 is to be installed. Next, as shown in FIG. 5, the affixing member 14 is affixed to the toilet top surface 2*a* of the flush toilet main body 2 using two affixing bolts 14*a*.

At the same time, the wash water supply pipe 20 is connected to the upstream end (inflow pipe portion 28*c*) of the bent supply pipe 28, and the downstream end (outflow pipe portion 28*a*) of the bent supply pipe 28 connecting the wash water supply pipe 20 is connected from the bottom surface of the sanitary washing apparatus 18 to the connecting base end portion 24. Also, the power supply cable 22 connector is connected from the bottom surface of the sanitary washing apparatus 18 to a connecting terminal (not shown). In this state, the ends of the wash water supply pipe 20 and power supply cable 22 are inserted from the pipe opening 16 on the toilet top surface 2*a* of the flush toilet main body 2, and are pulled from the rear surface side of the flush toilet main body 2 through the plumbing passageway 2*e*. In addition, the bottom surface of the sanitary washing apparatus 18 is snap-fastened to the affixing member 14, which is affixed to the flush toilet main body 2, so that the toilet seat 4 is disposed at a predetermined position on the toilet top surface 2*a*. When this happens, the wash water supply pipe 20 and power supply cable 22 connected to the sanitary washing apparatus 18 is pushed into the interior of the flush toilet main body 2 through the pipe opening 16.

The wash water supply pipe 20 and power supply cable 22 introduced into the flush toilet main body 2 are guided by the side wall surface 32*a* and bottom wall surface 32*b* of the plumbing passageway 2*e*, and are smoothly pushed out to the rear surface side of the flush toilet main body 2. Here, the inside side wall surface 32*a* and bottom wall surface 32*b* are formed to slope from the inside in the left-right direction of the flush toilet main body 2 downward toward the outside. Therefore the ends of the guided wash water supply pipe 20 and power supply cable 22 are pushed out toward the rear of the flush toilet main body 2 and to the outside in the left-right direction thereof, so that installers can easily access the ends of the wash water supply pipe 20 and power supply cable 22 even in a small washroom space.

In the flush toilet apparatus 1 of the first embodiment, the affixing holes 12 and pipe opening 16 are covered (FIG. 4) by the toilet seat 4 sanitary washing apparatus 18 disposed on the toilet top surface 2*a*, so the wash water supply pipe 20 and the like passing through the pipe opening 16 can be concealed, and the exterior appearance of the entire flush toilet apparatus 1, and cleanability, can be improved. The pipe opening 16 through which the wash water supply pipe 20 is passed is formed further to the outside in the left-right direction than the affixing holes 12, and the center point C1 thereof is positioned further to the front than the center point C2 in the front-back direction of the affixing holes 12, therefore an installer, with easy visual confirmation of the wash water supply pipe 20 passing through the pipe opening 16, can dispose a toilet seat 4 in the appropriate location on the toilet top surface 2*a*, and has easy access to the wash water supply pipe during installation. In addition, the bent supply pipe 28 extends from the connecting base end portion 24 disposed on the side end portion at the rear of the toilet seat 4, so as to bend toward the inside in the left-right direction of the flush toilet main body 2, and the wash water supply pipe 20 is connected to this bent supply pipe 28 (FIG. 6). With respect to the pipe opening 16, on the other hand, the center point C1 thereof in the left-right direction is formed so as to be positioned further to the inside in the left-right direction than the connecting base end portion 24, and thus can be smoothly introduced into the pipe opening 16 without excessive bending of the wash water supply pipe 20 extending from the bent supply pipe 28, so that the toilet seat 4 can be easily placed at an appropriate location on the toilet top surface 2*a*, and the wash water supply pipe 20 can be securely hidden.

Also, using the flush toilet apparatus 1 of the present embodiment, the back end in the front-back direction of the pipe opening 16 is formed so as to be positioned further to the rear of the flush toilet main body 2 than the back end in the front-back direction of the affixing holes 12 (FIG. 4). Therefore when a ceramic flush toilet main body 2 is fired, the shrinkage direction L2 in the edge part of the affixing holes 12 and the shrinkage direction L1 in the edge part of the pipe opening 16 come close to being parallel, making it more difficult for "cracking" to occur during firing, so that flush toilet main body 2 yield can be improved.

In addition, in the flush toilet apparatus 1 of the present embodiment, the bent supply pipe 28 is rotatably connected to the connecting base end portion 24 (FIG. 6), therefore a wash water supply pipe 20 connected to the bent supply pipe 28 can be easily handled. Also, when placing a toilet seat 4 on the flush toilet main body 2, if force is applied to the wash water supply pipe 20 extending from the bottom surface of the sanitary washing apparatus 18 into the pipe opening 16, that force can be dissipated by the rotation of the bent supply pipe 28, therefore excessive force on the bent supply pipe 28 to which the wash water supply pipe 20 is connected, and the resulting breakage thereof, can be prevented.

Using the flush toilet apparatus 1 of the present embodiment, the back end in the front-back direction of the pipe opening 16 is formed to be positioned more to the front side of the flush toilet main body 2 than the connecting base end portion 24 (FIG. 4). As a result, when the wash water supply pipe 20 is pulled out toward the rear of the flush toilet main body 2 after the toilet seat 4 is mounted on the flush toilet main body 2, this tension force can be dissipated as compressive force on the bent supply pipe 28 as well. This allows the risk of breakage of the wash water supply pipe 20 and the like to be reduced when pulling the wash water supply pipe 20 using excessive force.

Moreover, in the flush toilet apparatus 1 of the present embodiment, a plumbing passageway 2*e* communicating with the pipe opening 16 is provided, and one of the side wall surfaces 32*a* thereof is positioned further to the inside in the left-right direction of the flush toilet main body 2 than the vertical plane P1 passing through the center point C1 in the left-right direction of the pipe opening 16. Thus when a wash water supply pipe 20, connected to a bent supply pipe 28 directed inward in the left-right direction, and itself directed inward in the left-right direction, is inserted into a pipe opening 16, the wash water supply pipe 20 hits the side wall surface 32*a* of the plumbing passageway 2*e* and is guided by same, to be pushed toward the rear of the flush toilet main body 2. Therefore an installer can, in a simple manner, direct a wash water supply pipe 20 inserted in a pipe opening 16 to the back side of the flush toilet main body 2.

Also, in the flush toilet apparatus 1 of the present embodiment, the plumbing passageway 2*e* side wall surface 32*a* and bottom wall surface 32*b* are sloped downward from the inside toward the outside in the left-right direction of the flush toilet main body 2 (FIG. 6), so that the wash water supply pipe 20 guided thereby is fed out from the plumbing passageway 2*e* toward the rear and outside of the flush toilet main body 2. Therefore an installer can easily access fed-out wash water supply pipes 20.

In addition, using the flush toilet apparatus 1 of the present embodiment, the plumbing passageway 2*e* bottom wall surface 32*b* is formed to slope downward toward the back of the flush toilet main body 2 (FIG. 6), so a wash water supply pipe 20 inserted into the plumbing passageway 2*e* can be easily fed out to the rear of the flush toilet main body 2. Also, flush water or condensate penetrating into the plumbing passageway 2*e* can be discharged from the plumbing passageway 2*e* by the slope of the bottom wall surface 32*b*.

In addition, with the flush toilet apparatus 1 of the present embodiment, the cross sectional area of the plumbing passageway 2*e* gradually increases toward the back of the flush toilet main body 2 (FIG. 6), therefore the wash water supply pipe 20, inserted into the plumbing passageway 2*e*, can be easily drawn through.

Furthermore, using the flush toilet apparatus 1 of the present embodiment, a packing 30, being a waterproofing member, is disposed between the toilet top surface 2*a* and the bottom surface of the toilet seat 4 sanitary washing apparatus 18 (FIG. 5), therefore wash water which has flowed over the toilet top surface 2*a* can be prevented from passing through the pipe opening 16 and penetrating into the flush toilet main body 2.

Figure 7:
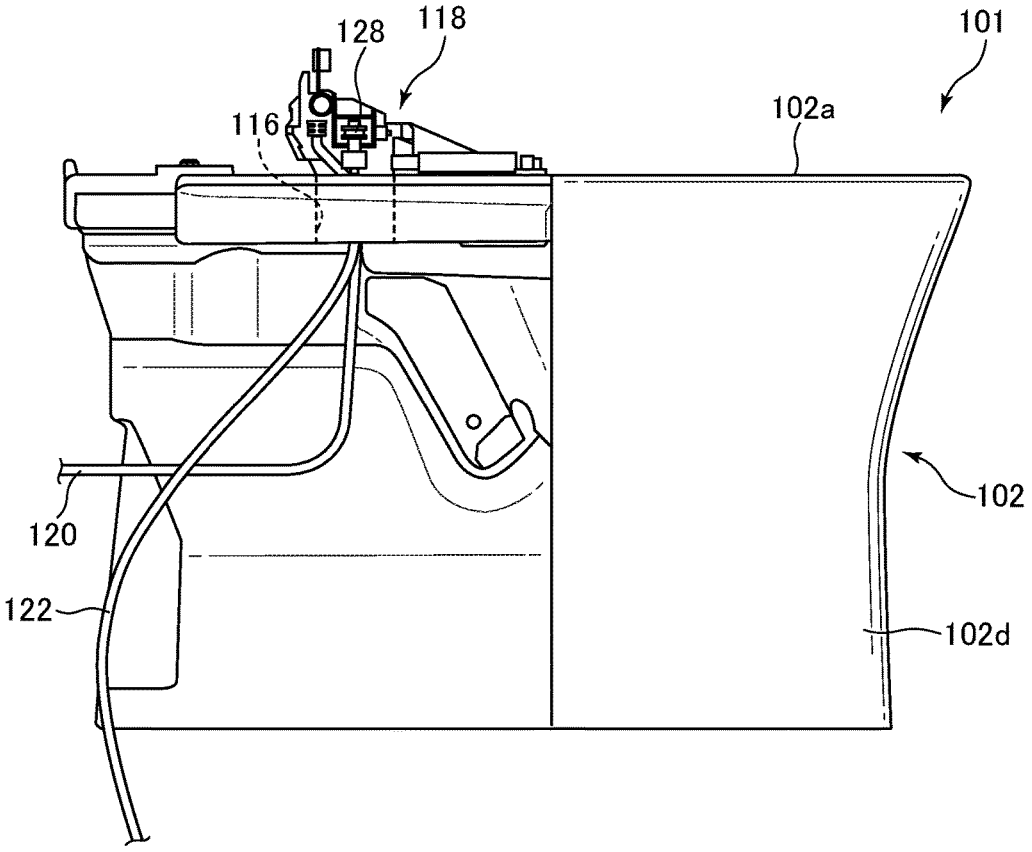
FIG. 7: A side elevation of a flush toilet apparatus according to a second embodiment of the invention.

Next, referring to FIG. 7, we explain a flush toilet apparatus according to a second embodiment of the present invention.

The flush toilet apparatus 101 of the present embodiment has the same constitution, operation, and effect as the above-described first embodiment, except for the different constitution of the flush toilet main body. Therefore only the points about the flush toilet apparatus in this embodiment which differ from the first embodiment are discussed here. FIG. 7 is a side elevation of a flush toilet apparatus according to a second embodiment of the invention, showing the case in which only a sanitary washing apparatus is installed on the flush toilet main body. I.e., FIG. 7 shows a case in which the reservoir tank, the seat portion of the toilet seat, the toilet seat cover, and the sanitary washing apparatus housing cover have been removed from the flush toilet apparatus of the second embodiment of the invention.

In the above-described first embodiment, the pipe opening 16 provided on the toilet top surface 2*a* of the flush toilet main body 2 (FIG. 5) communicates with the plumbing passageway 2*e* opened toward the rear of the flush toilet main body 2. Put another way, the flush toilet main body 2 in the first embodiment is a flush toilet main body of what is called the "full skirt" type, whereby the entire perimeter is surrounded by a skirt portion 2*d* (FIG. 1), and wash water supply pipes or the like extending from the sanitary washing apparatus 18 are drawn out from the rear through the inside of the skirt portion 2*d*.

In contrast, as shown in FIG. 7, a skirt portion 102*d* is provided on only the front side half of the flush toilet main body 102 of the second embodiment of the invention, and the rear side is covered by the skirt portion. Therefore in the present embodiment the flush toilet main body 102 comprises a structure corresponding to the plumbing passageway in the first embodiment. Hence, after passing through the pipe opening 116 disposed on the toilet top surface 102*a*, the wash water supply pipe 120 and power supply cable 122 extending from the sanitary washing apparatus 118, as viewed from the side surface of the flush toilet main body 102, are exposed to the outside. However the wash water supply pipe 120 and the like, although passing through a pipe opening 116 and being exposed from the side below the toilet top surface 102*a*, are hidden from above and therefore difficult for a user to see, so there is no significant loss in the exterior appearance of the flush toilet apparatus 101.

Thus the present invention can also be applied to flush toilet apparatuses comprising a flush toilet main body which is not of the "full skirt" type.

We have explained above a preferred embodiment of the invention above, however several variations can be added to the above-described embodiment.

EXPLANATION OF REFERENCE NUMERALS

1: flush toilet apparatus according to a first embodiment of the invention
2: flush toilet main body
2*a*: toilet top surface
2*b*: bowl portion
2*c*: discharge trap pipe
2*d*: skirt portion
2*e*: plumbing passageway
4: toilet seat
4*a*: seat portion
4*b*: toilet seat cover
6: reservoir tank
6*a*: operating portion
8: wash water supply hole
8*a*: center water conduit
8*b*: first water conduit
8*c*: second water conduit
10*a*: first spout port
10*b*: second spout port
12: affixing holes
14: affixing member
14*a*: affixing bolts
16: pipe opening
18: sanitary washing apparatus
18*a*: jet nozzle
18*b*: nozzle drive device
18*c*: heating device
18*d*: microprocessor
20: wash water supply pipe
22: power supply cable
24: connecting base end portion
26: electromagnetic valve
28: bent supply pipe
28*a*: outflow pipe portion
28*b*: horizontal pipe portion
28*c*: inflow pipe portion
30: packing (waterproofing member)
32*a*: side wall surface
32*b*: bottom wall surface
101: flush toilet apparatus according to a second embodiment of the invention
102: flush toilet main body
102*a*: toilet top surface
116: pipe opening
118: sanitary washing apparatus
120: wash water supply pipes
122: power supply cable

The invention claimed is:

1. A flush toilet apparatus comprising a flush toilet main body and a sanitary washing apparatus mounted on a rear portion of a top surface thereof, comprising:

a bent supply pipe extending from a connecting base end portion toward an inside in a left-right direction of the flush toilet main body to supply wash water to the sanitary washing apparatus, the connecting base end portion being disposed on a side end portion of a bottom surface of the sanitary washing apparatus;

a wash water supply pipe connected to the bent supply pipe, to supply the wash water into the bent supply pipe; and an affixing member, disposed between the bottom surface of the sanitary washing apparatus and the top surface of the toilet main body, for affixing the sanitary washing apparatus to the flush toilet main body;

wherein an affixing hole for affixing the affixing member to the flush toilet main body, and a pipe opening for admitting the wash water supply pipe are formed on the top surface of the toilet main body;

the affixing hole and the pipe opening are formed so as to be covered by the sanitary washing apparatus mounted on the top surface;

the pipe opening is positioned on an outer side of the affixing hole in the left-right direction of the flush toilet main body, and a center point in a front-back direction of the pipe opening is positioned on a front side of a center point in a front-back direction of the affixing hole;

the pipe opening is positioned on a same side of the connecting base end portion in the left-right direction of the flush toilet main body as seen in top view, and the pipe opening, as seen in top view, is formed so that a center point in a left-right direction of the pipe opening is positioned on an inner side of the connecting base end portion in the left-right direction of the flush toilet main body and the center point in the left-right direction of the pipe opening is positioned between the connecting base end portion and the affixing hole in the left-right direction of the flush toilet main body.

2. The flush toilet apparatus of claim 1, wherein the pipe opening is formed so that its back end point in the front-back direction of the flush toilet main body is positioned on a rear side of a back end point in the front-back direction of the affixing hole.

3. The flush toilet apparatus of claim 1, wherein the bent supply pipe is connected so as to be rotatable relative to the connecting base end portion, and a leading end of the bent supply pipe, to which the wash water supply pipe connects, is moved by the rotation of the bent supply pipe in an approximately horizontal plane.

4. The flush toilet apparatus of claim 3, wherein the pipe opening is formed so that its back end point in the front-back direction, as seen in top view, is positioned on the front side of the connecting base end portion.

5. The flush toilet apparatus of claim 1, wherein a plumbing passageway, communicating with the pipe opening and opened toward the rear of the flush toilet main body, is provided in the flush toilet main body, wherein one of side wall surfaces forming the plumbing passageway is positioned on the inside of a vertical plane in the left-right direction of the flush toilet main body, the vertical plane passing through the center point in the left-right direction of the pipe opening, whereby the one of the side wall surfaces guides a wash water supply pipe connected to the bent supply pipe.

6. The flush toilet apparatus of claim 5, wherein the side wall surfaces and a bottom wall surface of the plumbing passageway for guiding the wash water supply pipe are formed to slope downward, from the inside toward the outside in the left-right direction of the flush toilet main body.

7. The flush toilet apparatus of claim 5, wherein a bottom wall surface of the plumbing passageway is formed to slope downward toward the back of the flush toilet main body.

8. The flush toilet apparatus of claim 5, wherein a cross sectional area of the plumbing passageway is formed to gradually increase toward the back of the flush toilet main body.

9. The flush toilet apparatus of claim 1, wherein a water proofing member for constraining a penetration of water into the pipe opening is disposed between the top surface of the flush toilet main body and the bottom surface of the sanitary washing apparatus.

* * * * *